US006510980B2

(12) United States Patent
Halbrook, Jr. et al.

(10) Patent No.: US 6,510,980 B2
(45) Date of Patent: Jan. 28, 2003

(54) MASS PRODUCED BUSINESS MAILER

(75) Inventors: Wendell B. Halbrook, Jr., Waynesville, OH (US); Timothy W. Rawlings, Waynesville, OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/837,958

(22) Filed: Apr. 19, 2001

(65) Prior Publication Data

US 2002/0153407 A1 Oct. 24, 2002

(51) Int. Cl.[7] ..... B65D 27/00

(52) U.S. Cl. ..... 229/92.1; 229/80; 428/40.1

(58) Field of Search ..... 229/92.1, 80, 92.8, 229/80.5; 283/61, 62, 116, 101; 462/25, 26; 428/40.1

(56) References Cited

U.S. PATENT DOCUMENTS 2,896,351 A * 7/1959 Johnson ..... 40/702
3,304,641 A * 2/1967 Gonczy ..... 40/773
3,503,835 A * 3/1970 Hermann ..... 428/42.2
4,953,780 A * 9/1990 Ross ..... 229/92.8
5,320,387 A * 6/1994 Carlson ..... 283/107
5,403,236 A * 4/1995 Greig ..... 283/74
5,466,502 A * 11/1995 Wilkinson et al. ..... 283/100
5,501,393 A 3/1996 Walz
5,580,640 A 12/1996 Kraft et al.
5,601,313 A * 2/1997 Konkol et al. ..... 281/2
5,633,071 A * 5/1997 Murphy ..... 229/92.1
5,705,243 A * 1/1998 Mehta et al. ..... 428/40.1
5,842,722 A * 12/1998 Carlson ..... 283/107
5,890,743 A * 4/1999 Garrison et al. ..... 283/107
6,217,078 B1 * 4/2001 Roth et al. ..... 283/101
6,257,624 B1 * 7/2001 Fabel ..... 283/116
6,361,078 B1 * 3/2002 Chess ..... 229/92.8
6,410,111 B1 * 6/2002 Roth et al. ..... 283/81

OTHER PUBLICATIONS wallace.com, "Wallace News & Highlights—New Product Announcements," May 13, 1999, two pages.

* cited by examiner

*Primary Examiner*—Jes F. Pascua
(74) *Attorney, Agent, or Firm*—Francis L. Conte

(57) ABSTRACT

A business mailer includes a face sheet having a strip of adhesive bonded to one side thereof along a corresponding edge. A liner is bonded to the face sheet atop the adhesive strip, and is severed around a central strip tab for being removed from a surrounding border of the liner for exposing the adhesive strip. This integrated construction may be printed at high speed following which the liner tab is removed and the face sheet folded to form an adhesively sealed business mailer.

20 Claims, 4 Drawing Sheets

MASS PRODUCED BUSINESS MAILER

BACKGROUND OF THE INVENTION

The present invention relates generally to stationery products, and, more specifically, to mass produced business mailers.

Various businesses have various needs for mass mailing printed information to various recipients. For example, advertisements may be mailed to potential customers for announcing any desired advertised promotion. Utility companies send billing and other information to its customers. Employers send salary information to their employees, and, mail-order retailers send itemized billing information to their customers.

These are only examples of the variety of mass mailings which occur daily throughout the country. The variety of business mailers also varies, and includes the typical folded self-mailers and business reply mail which require different levels of confidentiality or sealing thereof.

For example, a simple folded mailer may be in the form of a single sheet of printed paper folded in half and joined together by glue, adhesive, tape, or staples. The edges of the folded sheet may be sealed locally or around the full perimeter thereof.

Since business mailing typically occurs in large periodic volume, high speed processing thereof is a significant objective. Correspondingly, minimizing costs is another important objective in mass mailings.

High speed printers are available in various conventional forms including high speed laser printers feeding cut sheet or continuous webs therethrough. A laser printer provides non-impact printing by hot fusing toner on the sheet as it is driven through the printer. High speed ink jet printers are also commonly available.

High speed printers typically operate at a printing speed in the range of 90 to 530 pages per minute, and therefore require significant precision of operation to avoid undesirable jamming of the sheets in the printing process. Accordingly, high speed printing is typically limited to the printing function on one or both sides of the face sheets carried through the printer, with subsequent operations then being required to complete the business mailer.

The printed sheets must be separately folded into the desired form and sealed in a suitable manner for delivery to the intended recipients. This overall process of printing and forming the business mailers requires a corresponding amount of processing time, labor, and associated costs.

Accordingly, it is desired to provide an improved business mailer for high speed production thereof.

BRIEF SUMMARY OF THE INVENTION

A business mailer includes a face sheet having a strip of adhesive bonded to one side thereof along a corresponding edge. A liner is bonded to the face sheet atop the adhesive strip, and is severed around a central strip tab for being removed from a surrounding border of the liner for exposing the adhesive strip. This integrated construction may be printed at high speed following which the liner tab is removed and the face sheet folded to form an adhesively sealed business mailer.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
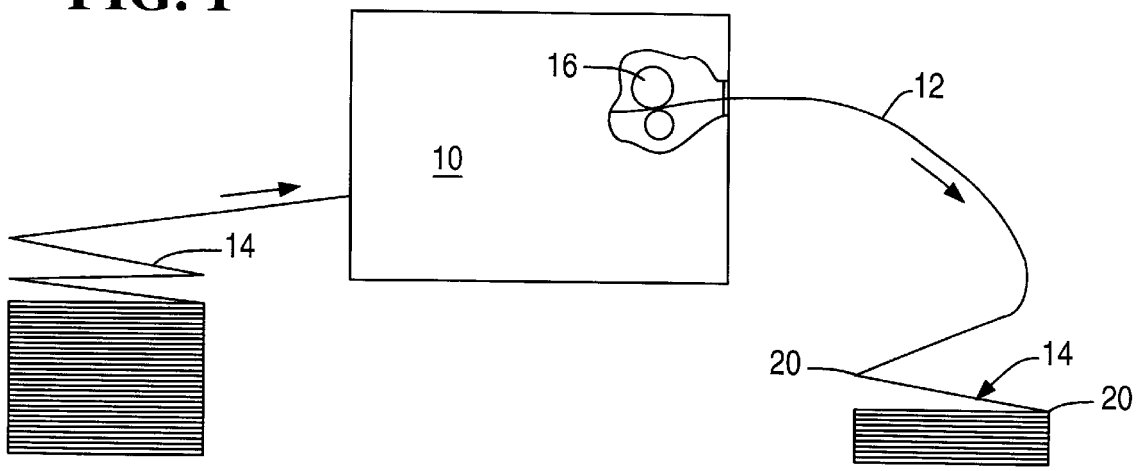
FIG. 1 is a schematic representation of a high speed printer printing a continuous web of business mailers in accordance with an exemplary embodiment of the present invention.

Illustrated in FIG. 1 is a high speed printer 10 which may have any conventional form for printing a continuous web 12 of a series of business mailers 14 in accordance with the present invention. High speed as used herein is greater than or equal to about 90 sheets or pages per minute and up to about 530 sheets per minute.

The high speed printer 10 may have any conventional configuration such as a laser printer including a hot fusing roller 16 therein. The laser printer includes various internal rollers for driving and guiding the web 12 therethrough, with the fusion roller being heated for fusing the printing toner on the web 12 in conventional manner.

The web 12 has precise dimensions and thickness to ensure non-jamming operation during the high speed printing thereof. For example, the overall thickness of the web 12 must be smaller than the several mil thickness specification for the printer for preventing jamming therein.

Figure 2:
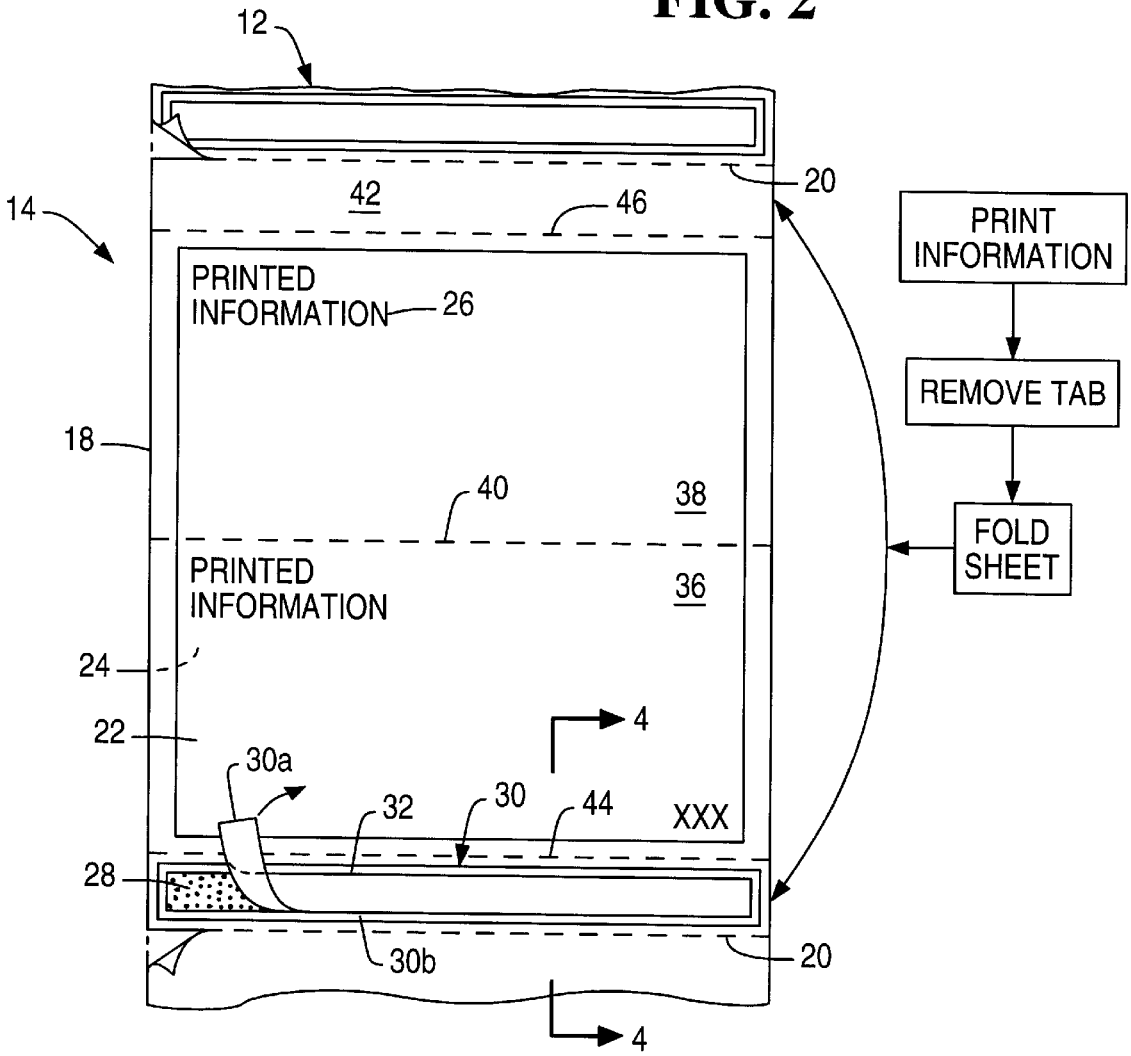
FIG. 2 is a plan view of one of the business mailers illustrated in FIG. 1 in accordance with an exemplary embodiment, including a flowchart representation of the manufacture thereof.

The web 12 illustrated in FIG. 1 is continuous and may be defined by fan folding the individual mailers 14 in a corresponding stack which is suitably fed through the printer and then restacked after the printing process. As shown in FIG. 2, each of the mailers 14 includes a unitary face sheet 18 of any suitable material composition, such as typical paper face stock of about 20 or 24 pounds per ream. The face sheets 18 are joined end-to-end in a continuous series at corresponding perforated separation lines 20, which permits separation of the face sheets from each other by simple tearing.

The face sheet 18 illustrated in FIG. 2 is rectangular and has opposite first and second sides or surfaces 22,24 upon which any desired printed information 26 may be printed by the printer. The printer may have duplex printing capability if desired for simultaneously printing both sides of the face sheet, or each side of the face sheet may be printed in a separate printing operation.

The face sheet also includes a strip of adhesive 28 permanently bonded to the first side of the face sheet along the bottom edge thereof for example. A release liner 30 is also permanently bonded to the face sheet first side atop the adhesive strip.

The liner is severed by a diecut 32 around a central strip tab 30*a* which is the rectangular middle portion of the liner that may be selectively removed from a surrounding border 30*b* defining a rectangular frame portion of the liner. Removal of the tab 30*a* exposes the adhesive strip 28*b* hidden therebelow.

Each of the mailers in the continuous web 12 illustrated in FIG. 2 is identical to each other with each face sheet having a respective one of the small liners 30 disposed over only a portion thereof. The remainder of the face sheet remains single ply.

Figure 3:
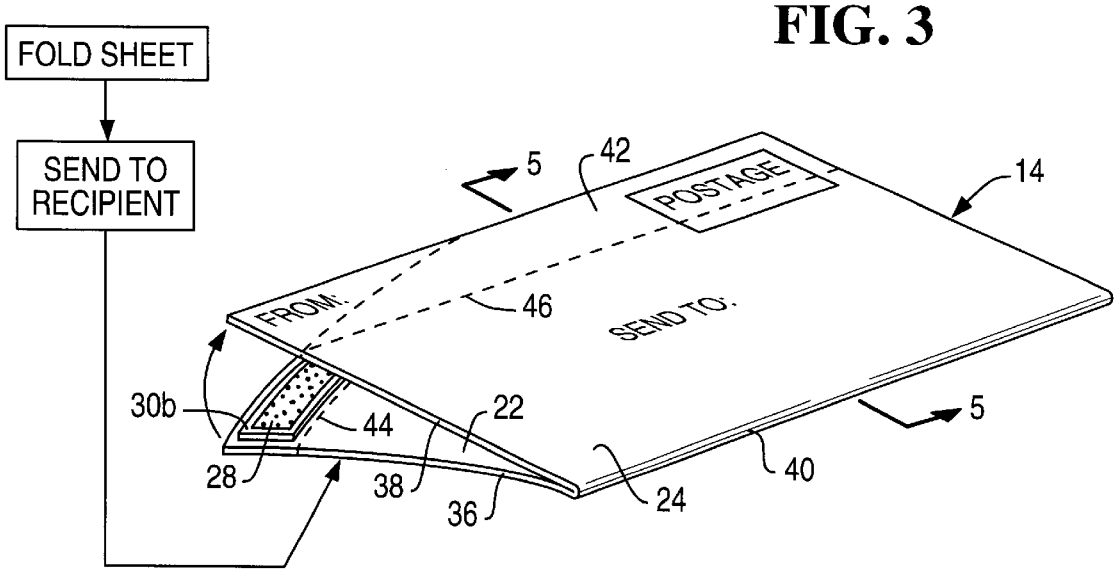
FIG. 3 is an isometric view of the business mailer of FIG. 2 being folded shut for delivery to a recipient.

FIG. 2 also illustrates schematically a preferred method of using the mailer 14 which begins by printing any desired information 26 on either one or preferably both sides 22,24 of the face sheet 18. The liner tab 30*a* may then be readily removed by being peeled away from the liner border due to the diecut 32. The face sheet 18 may then be folded in half to form a laminate bonded together by the now exposed adhesive strip 28 as illustrated in FIG. 3.

Figure 4:
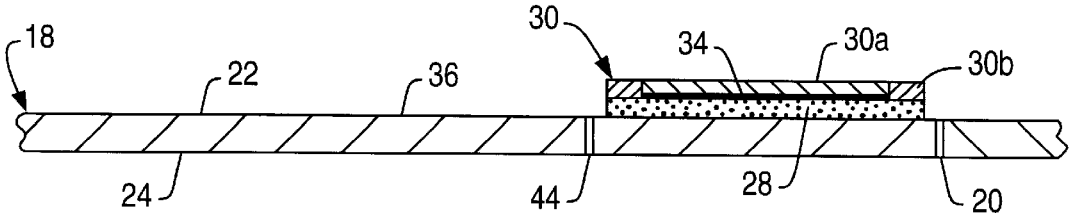
FIG. 4 is a sectional view of a portion of the business mailer illustrated in FIG. 2 and taken along line 4—4.

FIG. 4 illustrates a portion of the unfolded mailer in cross section, exaggerated in thickness for clarity of presentation. The liner 30 may have any conventional configuration such as supercalendered kraft paper which is substantially thinner than typical face stock, and a suitable release coating 34, in the form of silicone for example, is disposed solely under the tab 30*a*. The release coating is effective for creating a weak or temporary bond with the adhesive strip 28 for permitting removal of the tab when desired. The liner is devoid of the release coating under the surrounding border 30*b* so that the adhesive 28 creates a permanent bond between the border and the underlying portion of the face sheet.

This liner construction has several advantages. The liner 30 is limited in configuration to cover the adhesive strip 28, with the liner border being permanently bonded to the face sheet. This permanent bond prevents undesirable migration or squeeze-out of the adhesive as the mailer is carried through the laser printer of FIG. 1 and is subject to the hot temperature of the fusing roller 16. The high temperature of the fusing roller softens the pressure sensitive adhesive and could cause migration thereof but for the permanent bond thereof with the liner border.

The liner is thusly locked to the underlying face sheet for travel through the high speed printer, and delamination of the liner inside the printer is prevented. Liner delamination is undesirable since exposed adhesive may then cause the face sheet to bond to components in the transport path within the printer and cause undesirable jamming.

Furthermore, the liner 30 is relatively thin and is applied to only a portion of the face sheet for maintaining a relatively thin collective thickness of the mailer which remains within the small thickness specification for web travel through the printer. In this configuration, the mailer 14 may be printed at substantially high speed in the printer without increasing the likelihood of undesirable jamming of the laminate construction thereof.

Referring again to FIG. 2, the face sheet is preferably divided into first and second leaves or pages 36,38 symmetrically disposed on opposite sides of a fold line 40 to form mirror images. The fold line 40 may be as simple as a printed line, or a score, or a line of perforations as illustrated for precisely folding the two pages along the line 40 for later use in configuring the mailer as shown in FIG. 3 for delivery to the recipient.

As shown in FIG. 2, the adhesive strip 28 and the liner 30 are both disposed together in a lamination on only the first page 36 of the mailer. Correspondingly, the second page 38 includes a sealing or closure flap 42 disposed symmetrically opposite to the adhesive strip 28 and laminated liner which define a mirror-image band at the bottom of the first page 36 matching the flap 42 at the top of the second page 38.

FIG. 2 also illustrates the preferred use of a perforated first line 44 extending across the full width of the page 36 adjacent the adhesive strip 28, and a perforated second line 46 extending across the full width of the second page 38 adjacent the closure flap 42. The first and second perforation lines 44,46 are disposed symmetrically oppositely to each other about the fold line 40 so that they align together when the mailer is folded as illustrated in FIG. 3.

As shown in FIG. 3, the face sheet may be folded in any convenient manner along the fold line 40 to form the laminate of the two pages bonded together by the adhesive strip 28 at the closure flap 42. This bond is illustrated local magnification in FIG. 5 which provides a permanent bond and seal along both ends of the two pages opposite to the middle fold line thereof.

In the exemplary embodiment illustrated in FIGS. 2 and 3, the first and second pages 36,38 define respective halves of the unitary face sheet 18, with the pages being symmetrical about the horizontal fold line 40. The adhesive strip 28 extends only along the single, bottom edge of the first page of the face sheet parallel to the fold line 40. And, the liner 30 is a correspondingly narrow strip covering the adhesive strip 28 along the single bottom edge of the face sheet.

Figure 5:
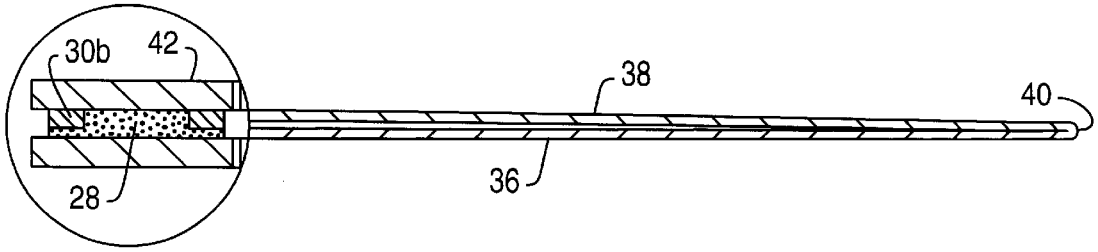
FIG. 5 is a sectional view of the folded business mailer illustrated in FIG. 3 and taken along line 5—5.

As indicated above, the narrow liner 30 illustrated in FIGS. 2 and 4 protects the adhesive from migration during high speed travel in the printer illustrated in FIG. 1, and permits printing without undesirable jamming of the laminate mailer during its travel through the printer. The liner tab 30*a* may be removed manually or in an automated high speed process, following which the face sheet is folded in half as illustrated in FIGS. 3 and 5.

The second side 24 of the face sheet is exposed in FIG. 3 and may contain thereon any desired printing such as the from and to addresses, with suitable postage applied thereto for mailing to the intended recipient. The printed first side 22 is hidden inside the folded mailer and remains substantially confidential and secure by the sealed shut flap 42.

Figure 6:
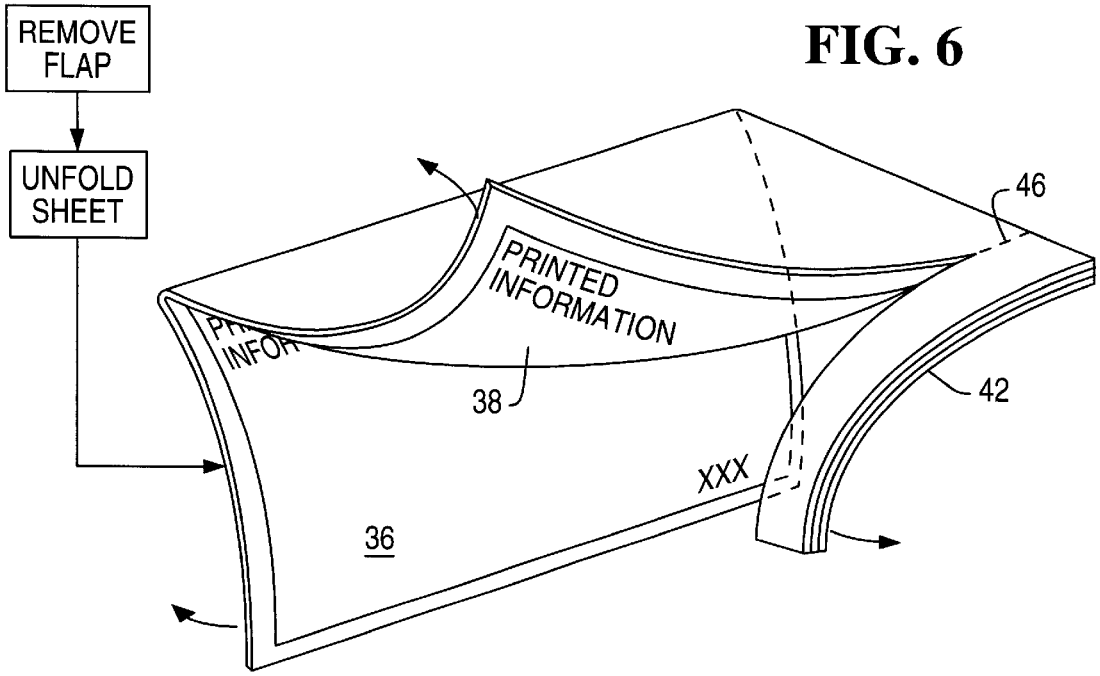
FIG. 6 is an isometric view of the business mailer illustrated in FIG. 3 being opened by removal of an integral closure flap thereof.

The so constructed mailer is then sent to the intended recipient in any conventional manner. As shown in FIG. 6, the recipient may then remove the closed flap 42 by tearing along the perforated line 46. The removed flap 42 carries with it the adhesive and remaining liner border along with a corresponding portion of the face sheet. The recipient may then simply unfold the two folded pages 36,38 for reading the printed information contained thereon. As indicated above, the form of the business mailer may be chosen for the specific application such as conveying information to the recipient, and the recipient may add any desired information to the opened mailer for return to the sender if desired.

Figure 7:
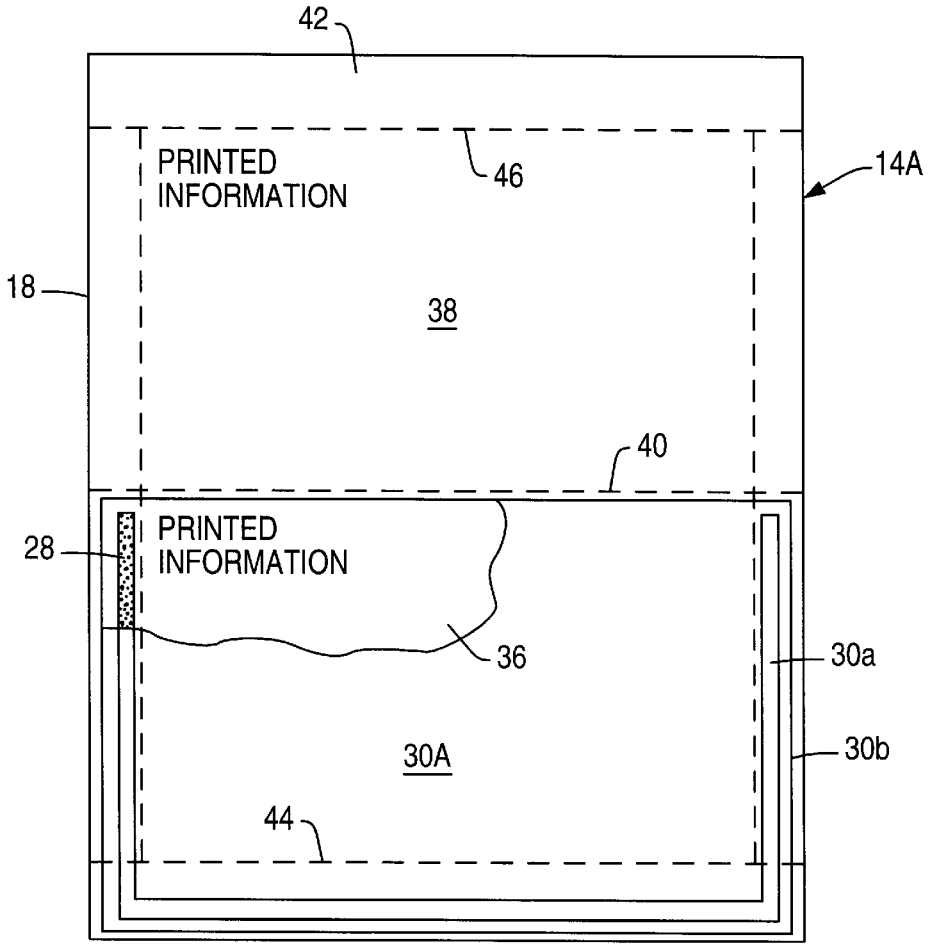
FIG. 7 is a plan view of a business mailer in accordance with another embodiment of the present invention.

FIG. 7 illustrates a modified form of the business mailer, designated 14A, which may be configured in single cut-sheet form, or in the continuous web 12 illustrated in FIG. 2. In this embodiment, the adhesive strip 28 extends along three edges of the face sheet 18 to surround the first page 36 to the fold line 40. The liner 30A in this embodiment preferably covers the entire first page atop the adhesive strip between the left and right sides and from the bottom to the fold line 40.

In this configuration, the adhesive strip 28 extends along the bottom edge of the first page 36 as well as along the left and right edges thereof so that the folded mailer is completely sealed around its four edges when laminated together.

In the configuration illustrated in FIG. 7, the first line 44 is perforated through both the first page 36 and the liner 30A laterally inside the adhesive strip 28 along the three edges of the face sheet. And, the second line 46 is perforated solely through the second page 38 in a matching generally U-shaped configuration with that of the first line 44. In this way, the correspondingly U-shaped liner tab 30*a* may be removed to expose the underlining adhesive 28 which follows that generally U-shape for permitting full perimeter sealing of the two pages 36,38 when folded together.

The recipient may then remove the three-edge band of the laminated mailer by tearing along the aligned first and second perforation lines 44,46. The two pages 36, 38 may then be unfolded for reading the information printed therein, and the center portion of the liner 38 is liberated from the mailer due to separation along the first perforation line 44. The liberated liner may be discarded as waste, or may be preprinted to include any desired information for use by the intended recipient.

Figure 8:
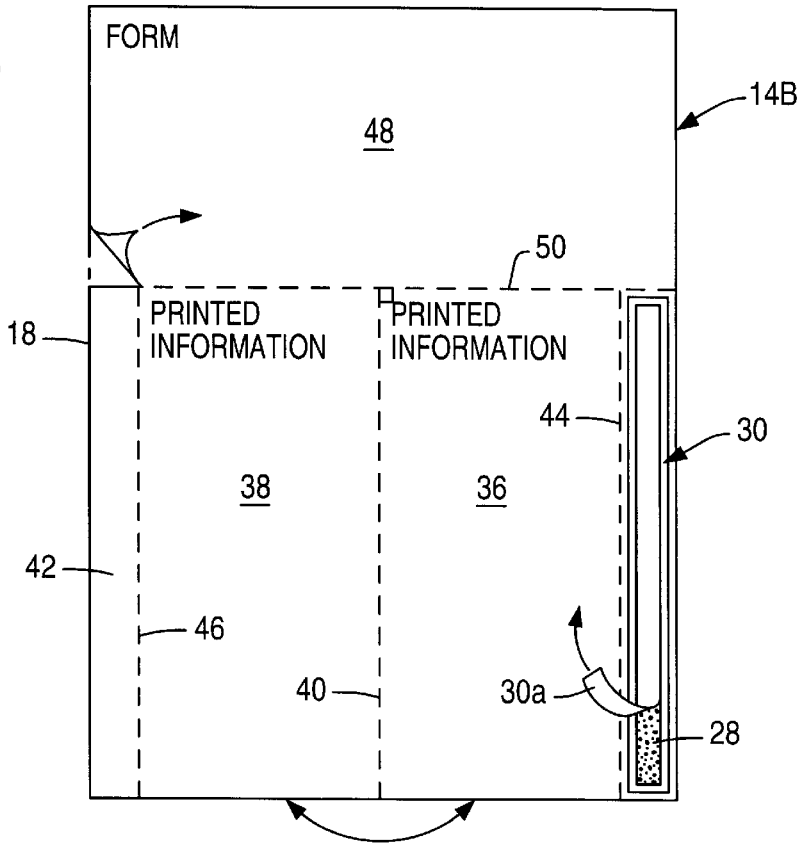
FIG. 8 is a plan view of a business mailer in accordance with another embodiment of the present invention.
Figure 9:
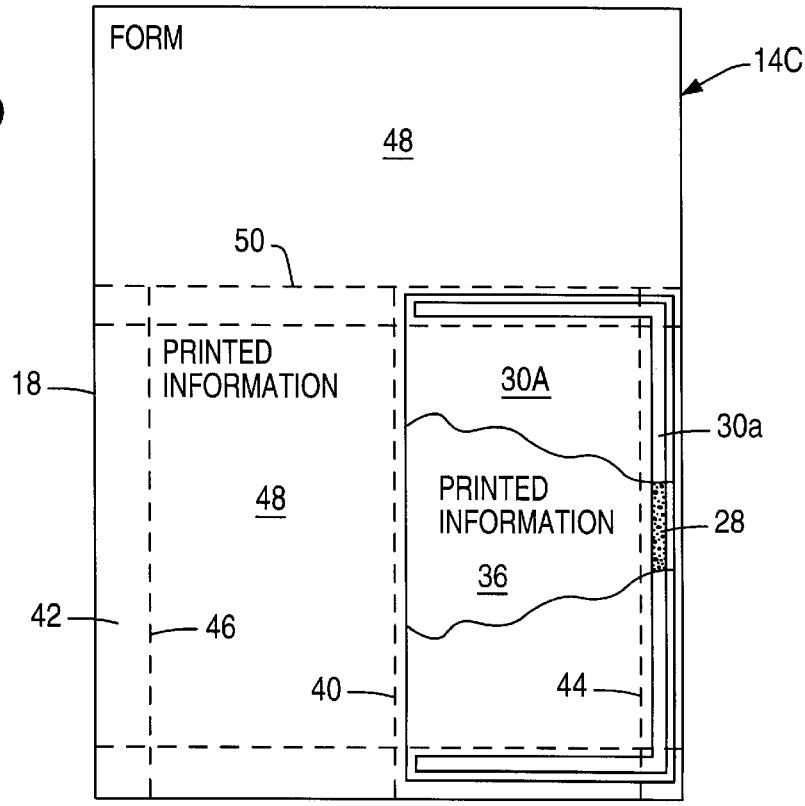
FIG. 9 is a plan view of a business mailer in accordance with another embodiment of the present invention.

FIGS. 8 and 9 illustrate two additional embodiments of the business mailer designated 14B and 14C which are variations of the mailer 14 illustrated in FIG. 2 and mailer 14A illustrated in FIG. 7. In both embodiments, the unitary face sheet 18 includes an integral form 48 adjoining both pages 36,38 a perforated third line 50. The form 48 may be used for any suitable purpose such as printing additional information thereon in the high speed printer of FIG. 1. The form 48 may be readily removed by being torn along the third line 50 liberating the remaining portion of the face sheet defining the two pages 36,38 which may be folded to form the mailer.

The two page construction illustrated in FIG. 8 is identical to the two page construction illustrated in FIG. 2 except for size and orientation, with the single adhesive strip 28 extending along the right side of the face sheet perpendicular to the third line 50. In this way, the two pages 36,38 may be folded left to right in FIG. 8 after removal of the liner tab 30*a* for adhesively bonding the flap 42 to the adhesive strip 28.

In FIG. 9, removal of the form 48 along the third line 50 leaves the two pages 36,38 which are identical to the two pages illustrated in FIG. 7 except for size and orientation. In FIG. 9, the adhesive strip 28 extends in first part parallel to and along a portion of the third line 50, and in second part along the right edge of the face sheet perpendicular to the third line 50, and in third part along the bottom edge of the face sheet parallel thereto and opposite to the third line 50. Upon removal of the liner tab 30*a* in FIG. 9, the two pages 36,38 may be folded together left to right for adhesively bonding the three exposed portions of the adhesive strip 28 to the corresponding three portions of the second page 38.

In the various embodiments disclosed above, the liner is securely adhesively locked to the underlying face sheet for transport through the high speed printer without premature delamination thereof or migration of the adhesive for preventing jamming of the printer. The so printed mailer may then be readily assembled by removing the liner tab and folding the two pages together for adhesive bonding. The adhesive strip and liner are therefore initially part of the original mailer itself and are carried through the high speed laser printer without concern for jamming thereof. The individual mailers are readily completed by removing the corresponding liner tabs and folding the two pages together for completing the process.

This simplified mailer construction accordingly reduces complexity of the mass mailing procedure, reduces associated labor required therefor, and reduces costs. The full edge bonding of the two pages of the mailer substantially increases security and confidentiality of the information printed inside the mailer. And, the three-edge bonding fully seals the mailer for protecting the contents therein.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured Letters Patent of the United States is the invention as defined and differentiated in the following claims in which we claim:

1. A business mailer comprising:

a face sheet having opposite first and second sides and a strip of adhesive bonded to said first side along one edge thereof;

a narrow liner bonded to said first side atop said adhesive strip in a two-ply lamination with said face sheet leaving a remainder of said face sheet exposed in one ply; and said liner being severed around a removable strip tab portion thereof for being removed from a surrounding border portion of said liner for exposing on said face sheet said adhesive strip below said strip tab.

2. A mailer according to claim 1 wherein said liner includes a release coating under said tab for effecting a temporary bond with said adhesive strip, and is devoid of said release coating under said border for effecting a permanent bond with said adhesive strip.

3. A business mailer comprising:

a face sheet having opposite first and second sides divided into first and second pages symmetrically disposed on opposite sides of a fold line, a strip of adhesive disposed on said first page and bonded to said first side along one edge thereof, and said second page includes a closure flap disposed symmetrically opposite to said adhesive strip;

a liner disposed on said first page and bonded to said first side atop said adhesive strip;

said liner being severed around a central strip tab portion thereof for being removed from a surrounding border portion of said liner for exposing said adhesive strip therebelow; and said liner includes a release coating under said tab for effecting a temporary bond with said adhesive strip, and is devoid of said release coating under said border for effecting a permanent bond with said adhesive strip.

4. A mailer according to claim 3 further comprising a perforated first line extending across said first page adjacent said adhesive strip, and a perforated second line extending across said second page adjacent said closure flap symmetrically opposite to said first line.

5. A mailer according to claim 4 wherein said fold line is a line of perforations.

6. A mailer according to claim 4 wherein said adhesive strip extends along a single edge of said face sheet parallel to said fold line.

7. A mailer according to claim 6 wherein said liner covers said adhesive strip along said single edge of said face sheet.

8. A mailer according to claim 4 wherein said adhesive strip extends along three edges of said face sheet to surround said first page to said fold line.

9. A mailer according to claim 8 wherein said liner substantially covers said first page atop said adhesive strip.

10. A mailer according to claim 9 wherein said first line is perforated through both said first page and liner laterally inside said adhesive strip along said three edges of said face sheet, and said second line is perforated solely through said second page.

11. A mailer according to claim 4 wherein said first and second pages define respective halves of said face sheet.

12. A mailer according to claim 4 wherein said face sheet further comprises an integral form adjoining said first and second pages along a perforated third line.

13. A mailer according to claim 12 wherein said adhesive strip extends perpendicular to said third line.

14. A mailer according to claim 12 wherein said adhesive strip extends in part along said third line, in part perpendicular thereto, and in part parallel thereto at an opposite edge of said face sheet.

15. A mailer according to claim 4 further comprising a continuous web including a plurality of said face sheets joined end-to-end at a perforated separation line, with each of said face sheets having a respective one of said liners disposed over only said first page thereof.

16. A method of using said mailer according to claim 4 comprising:

printing information on both sides of said face sheet;

removing said liner tab therefrom; and folding said face sheet along said fold line to form a laminate of said two pages bonded together by said adhesive strip at said closure flap.

17. A method according to claim 16 further comprising:

sending said mailer to a recipient;

removing said flap from said mailer; and unfolding said two pages.

18. A method according to claim 16 further comprising printing said information on said face sheet in a high speed printer at a rate greater than or equal to about 90 sheets per minute.

19. A method according to claim 18 wherein said printer is a laser printer having a hot fusing roller.

20. A method according to claim 19 further comprising printing a continuous web of said face sheets at said high speed.

* * * * *